US008779318B2

(12) United States Patent
Espeseth et al.

(10) Patent No.: US 8,779,318 B2
(45) Date of Patent: Jul. 15, 2014

(54) SWITCHING DEVICE AND A SWITCHGEAR

(71) Applicants: Robert Espeseth, Skien (NO); Jan-Arild Zinke, Porsgrunn (NO); Havard Hadland, Skien (NO)

(72) Inventors: Robert Espeseth, Skien (NO); Jan-Arild Zinke, Porsgrunn (NO); Havard Hadland, Skien (NO)

(73) Assignee: ABB Technology AB (CH)

( * ) Notice: Subject to any disclaimer, the term of this patent is extended or adjusted under 35 U.S.C. 154(b) by 0 days.

(21) Appl. No.: 13/925,418

(22) Filed: Jun. 24, 2013

(65) Prior Publication Data

US 2013/0341171 A1 Dec. 26, 2013

Related U.S. Application Data

(63) Continuation of application No. PCT/EP2010/070556, filed on Dec. 22, 2010.

(51) Int. Cl.
*H01H 33/66* (2006.01)

(52) U.S. Cl.
USPC ..... 218/124; 218/154; 218/43

(58) Field of Classification Search
USPC ..... 218/43, 124, 154
See application file for complete search history.

(56) References Cited

U.S. PATENT DOCUMENTS

| | | | | |
|---|---|---|---|---|
| 3,919,511 | A | 11/1975 | Noack | |
| 5,057,654 | A | 10/1991 | Meyer et al. | |
| 5,981,889 | A * | 11/1999 | Niklaus | 200/501 |
| 6,005,213 | A * | 12/1999 | Morita et al. | 218/124 |
| 6,653,918 | B1 * | 11/2003 | Johnson | 335/68 |
| 7,956,307 | B2 * | 6/2011 | Ahn | 218/154 |
| 8,183,485 | B2 * | 5/2012 | Ahn | 200/400 |
| 8,519,287 | B2 * | 8/2013 | Raabe et al. | 200/306 |
| 2001/0025827 | A1 * | 10/2001 | Hunger et al. | 218/43 |
| 2002/0179571 | A1 | 12/2002 | Rhein et al. | |
| 2004/0104201 | A1 | 6/2004 | Sato et al. | |
| 2005/0241928 | A1 | 11/2005 | McCord et al. | |
| 2008/0217153 | A1 | 9/2008 | Bottcher et al. | |

FOREIGN PATENT DOCUMENTS

| | | | |
|---|---|---|---|
| DE | 3528770 | A1 | 2/1987 |
| EP | 0291762 | A2 | 11/1988 |
| FR | 2680911 | A1 | 3/1993 |
| JP | 2001143582 | A | 5/2001 |
| WO | 0178100 | A1 | 10/2001 |
| WO | 2004032298 | A1 | 4/2004 |

OTHER PUBLICATIONS

European Search Report Application No. EP 09 17 9639 Completed: Apr. 26, 2010; Mailing Date: May 7, 2010 7 pages.
International Preliminary Report on Patentability Application No. PCT/EP2010/070556 Completed: Jan. 31, 2013 12 pages.

(Continued)

*Primary Examiner* — Truc Nguyen
(74) *Attorney, Agent, or Firm* — St. Onge Steward Johnston & Reens LLC

(57) ABSTRACT

A switching device for electric power distribution, electrically connectable to an electrical conductor, the switching device including a breaker electrically connectable to the electrical conductor, and an electrically conductive housing to which the breaker is mounted, the switching device providing a current path between the breaker and the electrical conductor, and the housing houses a guiding member for operating the breaker, the guiding member being movable in relation to the housing, the housing having an outer surface, wherein the housing has a smooth outer shape to distribute the electric field generated by the voltage of the current through the switching device. A switchgear including such a switching device.

13 Claims, 5 Drawing Sheets

(56) References Cited

OTHER PUBLICATIONS

International Search Report Application No. PCT/EP2010/070556 Completed: Mar. 29, 2011; Mailing Date: Apr. 4, 2011 4 pages Written Opinion of the International Preliminary Examining Authority Application No. PCT/EP2010/070556 Mailing Date: Nov. 26, 2012 5 pages.

* cited by examiner

SWITCHING DEVICE AND A SWITCHGEAR

TECHNICAL FIELD

The present invention relates to a switching device for electric power distribution, electrically connectable to an electrical conductor, for example a busbar, the switching device comprising a breaker electrically connectable to the electrical conductor, and an electrically conductive housing to which the breaker is mounted, the switching device providing a current path between the breaker and the electrical conductor. The housing houses at least one guiding member for operating the breaker, the at least one guiding member being movable in relation to the housing, and the housing has an outer surface. Further, the present invention relates to a switchgear comprising a switching device of the above-mentioned sort.

BACKGROUND OF THE INVENTION

Switchgears for medium and/or high voltage, e.g. 1-1000 kV, such as 12, 24 or 36 kV, of prior art normally comprise one to five modules housed in a casing, or encapsulation, and each module comprises at least three electrical bushings (one for each phase of a three phase AC power distribution system), conductors leading from each electrical bushing to a respective breaker, e.g. a vacuum interrupter, selector switches (one for each breaker), and busbars (one for each phase). The selector switches are used for connecting the breaker to the bus-bars or disconnecting them from the latter. Each selector switch normally comprises a switch knife pivotable between positions in which it is connected to or disconnected from the bus-bar.

The breaker is often a vacuum interrupter, which may be spring loaded, and is provided to interrupt the electric circuit upon occurrence of specific operational conditions. After such breaking, the selector switches may be manually or automatically disconnected from the respective busbar, either to a position in which the selector switch is connected to ground or an open position in which, for example, electric measurements on the components on the breaker side of the switch may be performed.

Examples of switchgears are disclosed in each of US2008/0217153 A1, US2004/0104201 A1 and DE 3528770 A1, in which a switchgear is disclosed, which for each phase has a breaker, a busbar, and a movable switching element which is pivotable between a first position, in which the switching element electrically connects the breaker to the busbar, a second position, in which the switching element is connected to ground/earth, and a third position in which the switching element is disconnected from both the busbar and ground, the third position corresponding to a switched-off position.

US 2005/0241928 A1 discloses an electric power interrupter with an internal contactor for use as a line or load switch constructed from light weight materials.

U.S. Pat. No. 3,919,511 discloses a circuit breaker equipped with a mechanism housing which is partly covered by half-shells consisting of electrically conductive material in order to not impair the electric field in the interior of the breaker housing.

U.S. Pat. No. 5,057,654 discloses an interrupter switch assembly provided with an interrupter unit having a moulded housing and a cover portion with which a conductive portion of a conductive shunt current path is integrally moulded, the conductive portion being generally a thin member or strip.

US 2002/0179571 A1 discloses an electrical circuit interrupter device for a power distribution system, comprising a housing made of a conductive material, e.g. aluminium, forming part of the electrical connection between a first terminal and a second terminal. The housing is connected to a circuit interrupter, e.g. a vacuum interrupter, situated between the first terminal and the housing, and the housing houses a manual handle and lever mechanism assembly for operating the circuit interrupter. Alternatively, the housing is made of a non-conductive material with a conductive shunt forming part of the electric connection between the first and second terminals.

THE OBJECT OF THE INVENTION

Switchgears should be designed to prevent the upcoming of discharges, arcs or flashover between components of the switchgear. Prior art switchgears may require too much space in order fulfill safety regulations, i.e. in order to prevent the upcoming of discharges or arcs. However, at the same time, there is a need for compact switchgears which require less space, but still with assured safety against disruptive discharge.

An object of the present invention is thus to reduce the risk of flashover, discharges or arcing between components or units of a switchgear.

A further object of the present invention is to provide a switchgear which has a compact design.

SUMMARY OF THE INVENTION

The above-mentioned objects of the present invention is attained by providing a switching device for electric power distribution, electrically connectable to an electrical conductor, the switching device comprising a breaker electrically connectable to the electrical conductor, and an electrically conductive housing to which the breaker is mounted, the switching device providing a current path between the breaker and the electrical conductor, and the housing houses at least one guiding member for operating the breaker, the at least one guiding member being movable in relation to the housing, the housing having an outer surface, wherein the housing has a smooth outer shape to distribute the electric field generated by the voltage of the current through the switching device.

The outer shape, or the outer geometry, of the housing is smooth in that the housing does not have an angular outer shape, e.g. with sharp corners or edges, and is without roughness.

By the present invention, the electric field, or electric field stress, generated by the voltage of the current through the switching device is evenly distributed in an efficient way, and the risk of flashover, discharges or arcing between the components of the switching device and between the housing and the surroundings, e.g. the housing of a switching device of another phase, or ground, is efficiently reduced. As a result, the switchgear provided with one or a plurality of the switching devices according to the present invention can be made more compact and less bulky, and less space for the switchgear is needed. Further, any additional shielding of the electric field is avoided. The provision of the at least one guiding member for operating the breaker inside the housing, also contributes to evenly distribution of the electric field.

As a result of the improved switching device, the need of electrically insulating gas inside an encapsulation in which a switching device is housed may be reduced, and possibly air instead of, for example, $SF_6$, may be used. However, the switching device of the present invention can advantageously be combined with encapsulations containing any insulating gas, e.g. $SF_6$, and the housing of the switching device may also be filled with, or contain, any insulating gas.

The breaker is adapted to open/interrupt the current path and adapted to close the current path. There are several prior art breakers well known to the person skilled in the art. A breaker has at least two states. A first state, which is a closed or conductive state, in which it conducts current through it, and a second state, which is an open or non-conductive state, in which it breaks/interrupts the current path through it and in which it is substantially non-conductive and does not conduct any current. Conventionally, a breaker is adapted to detect a fault condition and break the current upon fault detection, and thereafter, the breaker may be reset (manually or automatically) to resume normal conducting operation.

According to an advantageous embodiment of the switching device according to the present invention, the breaker is a vacuum interrupter, but the breaker can be in the form of any suitable type of breaker, such as a $SF_6$ gas interrupter.

According to an advantageous embodiment of the switching device according to the present invention, the switching device comprises the electrical conductor.

Advantageously, the electrical conductor is a busbar, but can also be in the form of any other the electrical conductor.

Advantageously, the housing is made of a suitable electrically conductive material, e.g. aluminium, such as cast aluminium. However, the housing can also be made of copper, zinc or any other suitable electrically conductive material. Casting, or moulding, an aluminium housing is a non-expensive procedure. Advantageously, the housing is plated with nickel or silver at certain locations, e.g. at electric connection areas.

According to an advantageous embodiment of the switching device according to the present invention, the outer surface of the housing is smooth to distribute the electric field generated by the voltage of the current through the switching device. The outer surface of the housing is smooth in that the outer surface has no roughness, projections or sharp indentations. The outer surface is evenly curved. By this embodiment, the even distribution of the electric field, or electric field stress, is further improved. The risk of flashover, discharges or arcing between components or units of a switchgear is further reduced, and the switchgear can have a more compact design.

According to a further advantageous embodiment of the switching device according to the present invention, at least one portion of the housing forms part of the current path between the breaker and the electrical conductor. By this embodiment, the distribution of the electric field and the electric field stress is further improved, and the switchgear can be given a more compact design without increasing the risk of flashover. Between the housing and the electrical conductor, an additional switch, e.g. as disclosed hereinafter, may be provided to form part of the current path between the housing and the electrical conductor.

According to another advantageous embodiment of the switching device according to the present invention, the housing comprises a first end portion, to which the breaker is mounted, and a second end portion including a terminal via which the current path exits the housing to reach the electrical conductor, the housing extending axially between the first and second end portions of the housing, and the housing is adapted to form a part of the current path which extends between the first and second end portions, i.e. said part extends between the first and second end portions.

In US 2002/0179571 A1, the current path through the circuit interrupter device goes through the a terminal, through the stationary contacts of the vacuum interrupter, through an adapter to a strap and through the strap to a conductive support tube of an electric control, and from this support tube to a second terminal via the conducive housing. Thus, the housing per se is only a minor part of the current path between the movable contact of the vacuum interrupter and the second terminal, and the housing conducts current only along a limited portion of the entire housing. Further, as described above, several different conducting elements housed within the housing are part of the current path in US 2002/0179571 A1. In the switching device of the present invention, the housing forms substantially the entire current path between the breaker and the terminal, and the housing conducts current along a substantial length of the axial extension of the housing, providing an improved distribution of the electric field and the electric field stress in relation to prior art switching devices, and the risk of flashover between the housing and the surroundings, for example the housing of a switching device of another phase, is further reduced. As a result, the switchgear can have an even more compact design, and any additional shielding of the electric field in relation to the surroundings can be avoided or reduced. Further, by this embodiment the switching device can be manufactured using fewer components, which improves the production of the switching device, and also improves the distribution of the electric field.

According to a further advantageous embodiment of the switching device according to the present invention, the housing is adapted to form a part of the current path which extends between the first end portion of the housing and the terminal, i.e. said part extends between the first end portion and the terminal. By this embodiment, the distribution of the electric field and the electric field stress is further improved.

According to another advantageous embodiment of the switching device according to the present invention, the breaker comprises an electrically conductive first contact and an electrically conductive second contact, the second contact being movable in relation to the first contact and in relation to the housing, and when the first and second contacts are in contact the breaker is in a closed position, and when the first and second contacts are separated the breaker is in an open position, and in that the second contact is electrically connected to the housing at the first end portion thereof. By this embodiment, the distribution of the electric field and the electric field stress is further improved.

According to yet another advantageous embodiment of the switching device according to the present invention, the housing is adapted to be at an electric potential which is substantially equal to the electric potential of the second contact of the breaker during the operation of the switching device. By this embodiment, the distribution of the electric field and the electric field stress is further improved.

According to still another advantageous embodiment of the switching device according to the present invention, the housing has an inner surface which comprises a contact surface, the second contact of the breaker being provided with a sliding contact element which is in electrical contact with the second contact, and the sliding contact element is in sliding and electrical contact with the contact surface of the housing. By this embodiment, the production of the switching device is facilitated, and the distribution of the electric field is also further improved.

According to an advantageous embodiment of the switching device according to the present invention, the housing has an inner surface which comprises a contact surface, the switching device comprising a flexible electrical conductor having a first end portion and a second end portion, the first end portion of the flexible electrical conductor being electrically connected to second contact of the breaker, and the second end portion of the flexible electrical conductor being electrically connected to the contact surface of the housing.

According to a further advantageous embodiment of the switching device according to the present invention, the first end portion of the housing includes the contact surface.

According to another advantageous embodiment of the switching device according to the present invention, the housing is adapted to form a part of the current path which extends between the contact surface of the housing and the terminal, i.e. it is said part that extends between the contact surface and the terminal. By this embodiment, the distribution of the electric field and the electric field stress is further improved.

According to still another advantageous embodiment of the switching device according to the present invention, the housing houses at least one conducting member, for example a strap, or a strip, which forms part of the current path between the breaker and the electrical conductor. Advantageously, said conducting member may form a part of the current path which extends between the first and second end portions, e.g. between the first end portion and the terminal, or e.g. between the contact surface of the housing and the terminal. This embodiment is advantageous if the housing is made of a material having poor conductivity, e.g. zinc, whereupon the conducting member conducts the current.

According to still another advantageous embodiment of the switching device according to the present invention, the switching device comprises a switch for electrically connecting the housing to the electrical conductor, the switch comprising a switch element movable to a first position in which the switch element is electrically connected to the housing and to the electrical conductor, movable to a second position in which the switch element is disconnected from the electrical conductor and electrically connected to the housing and to a grounded element, and movable to a third position in which the switch element is disconnected from the electrical conductor and from the grounded element. By this embodiment, the distribution of the electric field and the electric field stress is further improved, and this embodiment enables a switchgear having a further improved compactness.

According to yet another advantageous embodiment of the switching device according to the present invention, in the first position the switch element is electrically connected to the terminal of the housing and to the electrical conductor. By this embodiment, the distribution of the electric field and the electric field stress is further improved, and this embodiment enables a switchgear having a further improved compactness.

According to an advantageous embodiment of the switching device according to the present invention, the switch element has a first end portion and a second end portion between which the switch element extends, wherein in the first position the first end portion of the switch element is electrically connected to the terminal of the housing and the second end portion of the switch element is electrically connected to the electrical conductor, wherein in the second position the second end portion of the switch element is disconnected from the electrical conductor and electrically connected to the housing, and the first end portion of the switch element is connected to the grounded element, and wherein in the third position the first and second end portions of the switch element are electrically connected to the housing. By this embodiment, the distribution of the electric field and of the electric field stress is further improved.

According to yet another advantageous embodiment of the switching device according to the present invention, in the third position, the switch element is situated within the outer surface of the housing. By this embodiment, the dielectric performance of the switching device is not impaired, and the distribution of the electric field and of the electric field stress is further improved.

According to still another advantageous embodiment of the switching device according to the present invention, the switch element is pivotable about an axis of rotation and pivotable between the first, second and third positions.

According to an advantageous embodiment of the switching device according to the present invention, the axis of rotation of the switch element is located outside the outer surface of the housing. By this embodiment, the switch element may be pivotally mounted to its axis of rotation outside the housing, and the distribution of the electric field and of the electric field stress is further improved.

According to another advantageous embodiment the switching device according to the present invention, the axis of rotation of the switch element is located outside the switch element.

According to a further advantageous embodiment of the switching device according to the present invention, the housing is provided with a through-hole for suspension of the housing. Hereby, an efficient suspension of the housing is provided which does not impair the distribution of the electric field to any substantial extent.

According to an advantageous embodiment of the switching device according to the present invention, the outer surface of the housing is smoothly curved towards and into the through-hole. Hereby, a so called triple point with high dielectric stress is avoided. This is advantageous when using a shaft which is inserted into the through-hole.

According to another advantageous embodiment of the switching device according to the present invention, the switching device comprises a shaft inserted into the through-hole of the housing, the shaft is rotatable about its longitudinal axis and in relation to the housing, the shaft is connected to the at least one guiding member, and the shaft and its rotation is adapted to control the movement of the at least one guiding member. Hereby, an efficient control of the breaker is provided, which does not impair the distribution of the electric field to any substantial extent. Advantageously, when each of a plurality of phases, e.g. three phases, is provided with the innovative switching device, the same shaft is inserted into the through-hole of each housing to control the movement of the at least one guiding member of all the housings. Alternatively, instead of using said shaft to operate the breaker, two pulling/pushing rods may be used, one for opening the breaker and one for closing the breaker. Other embodiments for controlling the breaker are also possible.

According to still another advantageous embodiment of the switching device according to the present invention, the housing is made of at least one casted part. Advantageously, the housing can be made of two casted parts which are joined by suitable means. By these embodiments, the breaker will be efficiently supported, and a mechanically stable switching device and system are attained.

The above-mentioned objects of the present invention is also attained by providing a switchgear for electric power distribution, the switchgear comprising at least one switching device, wherein the switching device comprises the features mentioned in any of the claims 1 to 14, and/or the features of any of the above-mentioned embodiments. Hereby, a switchgear having both a compact design and a reduced risk of flashover, discharges or arcing between components or units of a switchgear is attained.

According to an advantageous embodiment of the switchgear according to the present invention, the switchgear comprises such a switching device for each phase.

The switching device and/or the switchgear according to the present invention is/are advantageously adapted for medium and/or high voltage, e.g. 1 kV and above.

The above-mentioned embodiments and features can be combined in various possible ways providing further advantageous embodiments.

Further advantageous embodiments of the switching device and the switchgear according to the present invention and further advantages with the present invention emerge from the detailed description of embodiments.

BRIEF DESCRIPTION OF THE DRAWINGS

The present invention will now be described, for exemplary purposes, in more detail by way of embodiments and with reference to the enclosed drawings, in which.

DETAILED DESCRIPTION OF PREFERRED EMBODIMENTS

Figure 1:
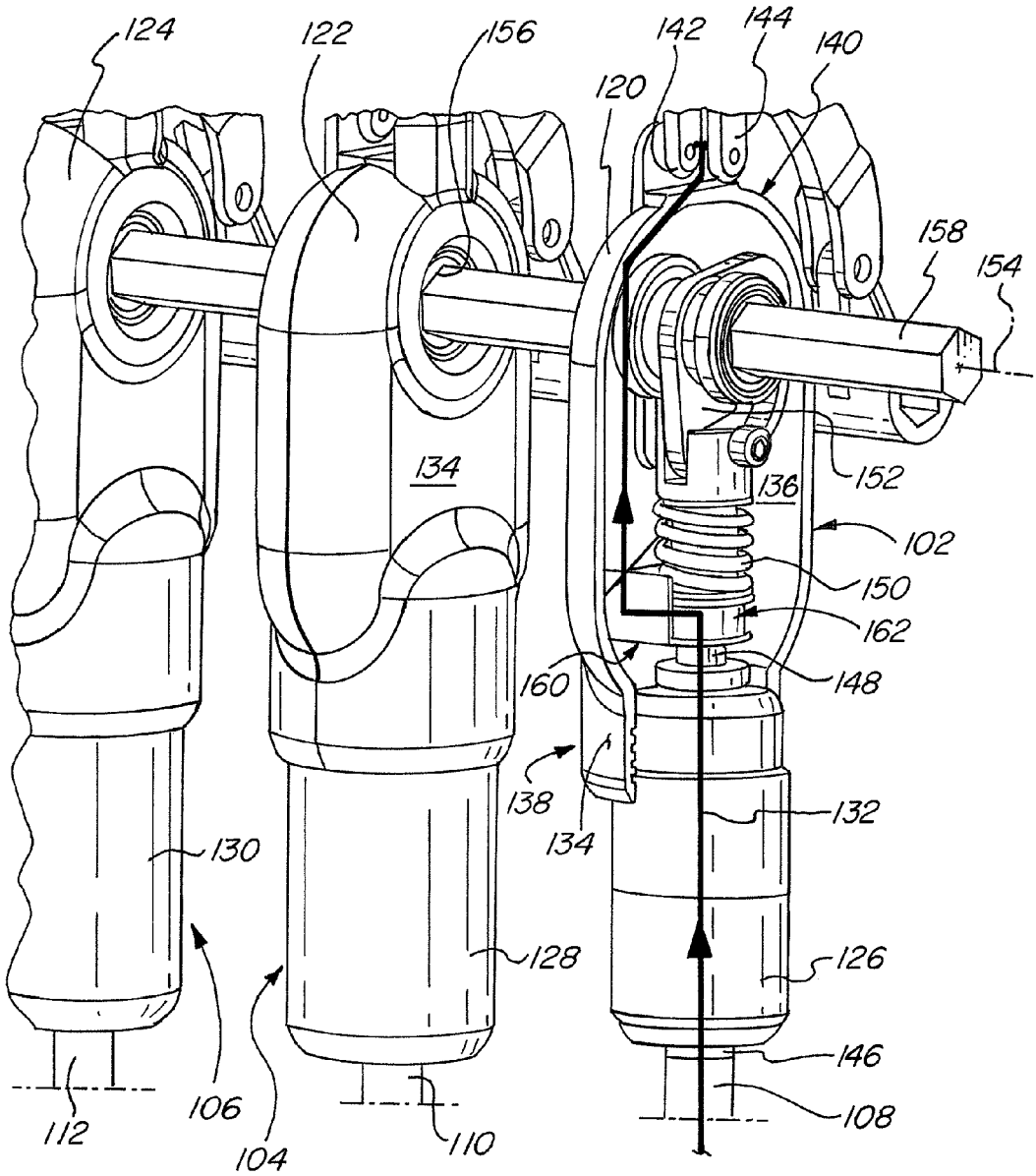
FIG. 1 is a schematic partial view of a first embodiment of the switchgear according to the present with three first embodiments of the switching device according to the present invention.

FIG. 1 shows schematically a first embodiment of the switchgear according to the present with three first embodiments of the switching device 102, 104, 106 according to the present invention, where one of the switching devices 102 has a part of the housing cut away for illustrative purposes. The shown switchgear is an electric power distribution switchgear and comprises a number of switching devices 102, 104, 106 which can be housed in an encapsulation (not shown). The encapsulation is penetrated by a number of electrical bushings (not shown), one for each phase of a plural phase system. From each electrical bushing a respective conducting element 108, 110, 112 extends to the respective switching device 102, 104, 106. On the outside of the encapsulation the electrical bushings are connected to cables (not shown) which either connect the switchgear to a load or to a medium or high voltage power distribution line.

Each switching device 102, 104, 106 is electrically connectable to and comprises an electrical conductor (not shown), in the form of a busbar, an electrically conductive housing 120, 122, 124, which is made of aluminium and made of two casted parts, and a breaker 126, 128, 130 mounted to the housing 120, 122, 124. The housing 120, 122, 124 overlaps part of the breaker 126, 128, 130. The switching device 102, 104, 106 provides a current path 132 between the breaker 126, 128, 130 and the electrical conductor, the current path 132 being illustrated by a bold line having a direction from below upwards through the switching device 102 to the right in the figure.

Each housing 120, 122, 124 has an outer surface 134 and an inner surface 136. The outer shape, or the outer geometry, of the housing 120, 122, 124 is smooth to distribute the electric field generated by the voltage of the current through the switching device 102, 104, 106. The outer shape of the housing 120 is smooth in that the housing does not have an angular outer shape and is without roughness. The outer surface 134 of the housing 120, 122, 124 is also smooth to distribute the electric field generated by the voltage of the current through the switching device 102, 104, 106. The outer surface 134 of the housing 120, 122, 124 is smooth in that the outer surface 134 has no roughness, sharp projections or sharp indentations.

At least one portion of the housing 120, 122, 124 forms part of the current path 132 between the breaker 126, 128, 130 and the electrical conductor. Each housing 120 comprises a first end portion, or end, 138, to which the breaker 126 is mounted, and a second end portion, or end, 140 including a terminal 142 via which the current path 132 exits the housing 120 to reach the electrical conductor, the housing 120 extending axially between the first and second end portions 138, 140. The terminal 142 is connectable to a switch 144 for connecting the housing 120 to the electrical conductor.

The breaker 126, 128, 130 is in the form of a vacuum interrupter and includes in a conventional way an electrically conductive first contact 146 and an electrically conductive second contact 148, the second contact 148 being movable in relation to the first contact 146 and in relation to the housing 120. When the first and second contacts 146, 148 are in contact the breaker 126 is in a closed (conducting) position, and when the first and second contacts 146, 148 are separated the breaker 126 is in an open (non-conducting) position. The breaker 126, 128, 130 is conventional and known to the skilled person and is therefore not described in more detail. It is to be understood that other breakers instead of the vacuum interrupter may also be used.

The housing 120 houses a plurality of guiding members 150, 152 for operating the breaker 126, including a biasing member 150, e.g. in the form a coil spring. The biasing member 150 may also be in form of other spring means, e.g. a dish spring etc. The biasing member 150 is connected to the second contact 148 of the breaker 120 and is adapted to bias the second contact 148 against the first contact 146 when the breaker 120 is in the closed position. The biasing member 150 is advantageously non-conductive. The biasing member 150 is axially movable in relation to the housing 120 and is in turn connected to a pivoting arm 152 which is rotatable about an axis of rotation 154, the rotation of the pivoting arm 152 effecting the axial movement of the biasing member 150 and the axial movement of the second contact 148 of the breaker 120. Each housing 120, 122, 124 is provided with a through-hole 156 for suspension of the housing 120, 122, 124, and the switchgear comprises a shaft 158 inserted into the through-hole 156 of each housing 120, 122, 124. The outer surface 134 of the housing 120, 122, 124 is smoothly curved towards and into the through-hole 156. By said smooth curvature of the outer surface, a so called triple point with high dielectric stress is avoided. The shaft 158 is rotatable about its longitudinal axis 154, which is coaxial with the axis of rotation 154 of the pivoting arm 152, and in relation to the housing 120, and the shaft 158 is connected to the pivoting arm 152. The rotation of the shaft 158 causes the pivoting arm 152 to rotate. The shaft 158 is adapted to control the movement of the second contact 148 of the breaker 126 by controlling the rotation of the pivoting arm 152 and thereby controlling the axial movement of the biasing member 150.

The inner surface 136 of the housing 120 comprises a contact surface 160 at the first end portion 138 thereof. The second contact 148 of the breaker 126 is provided with a sliding contact element 162 which is in electrical contact with the second contact 148 of the breaker 126, and the sliding contact element 162 is in sliding physical and electrical contact with the contact surface 160 of the housing 120. Thus, the second contact 148 is electrically connected to the housing 120 at the first end portion 138 of the housing 120, and the housing 120 forms a part of the current path 132, which current path part extends between the contact surface 160 of the housing 120 and the terminal 142.

Figure 2:
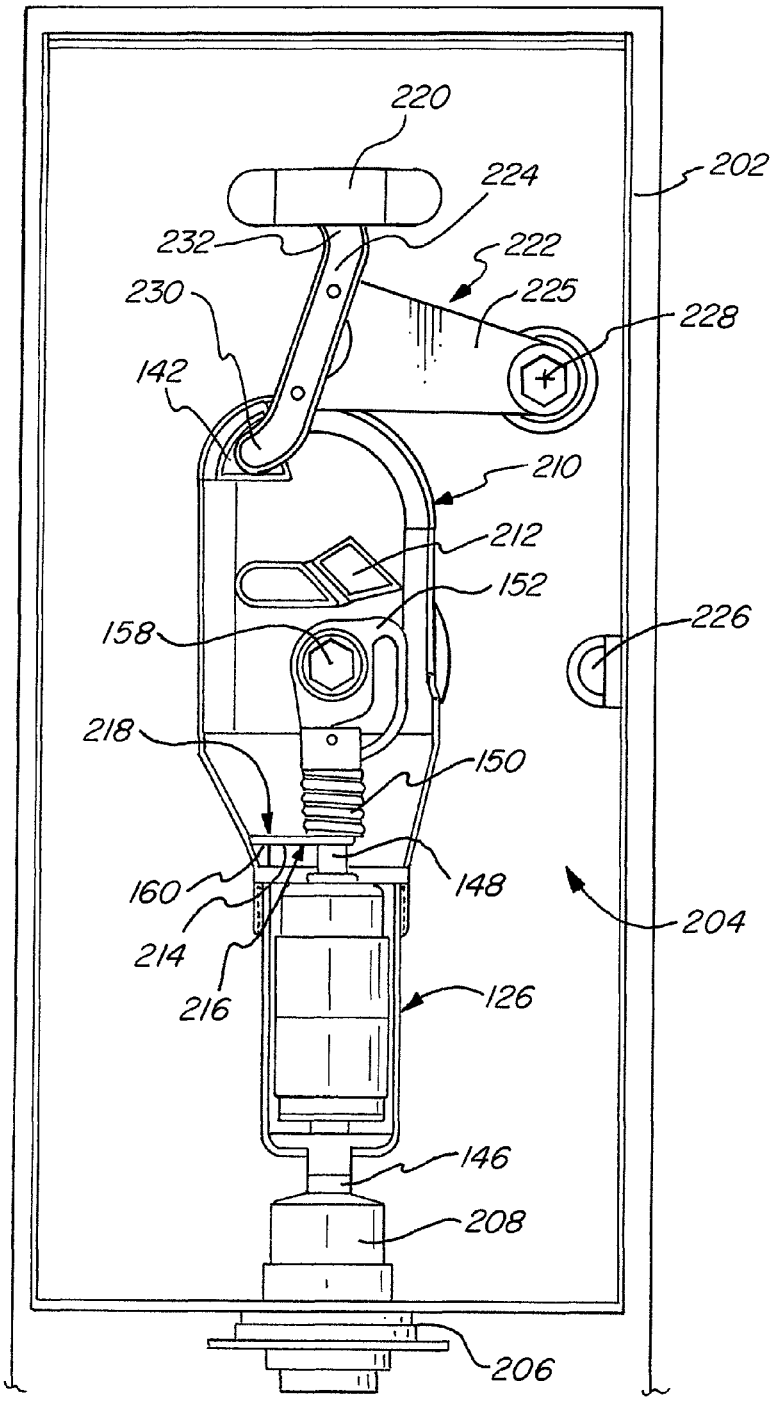
FIGS. 2-4 are schematic cutaway views of a second embodiment of the switchgear and a second embodiment of the switching device according to the present invention.
Figure 3:
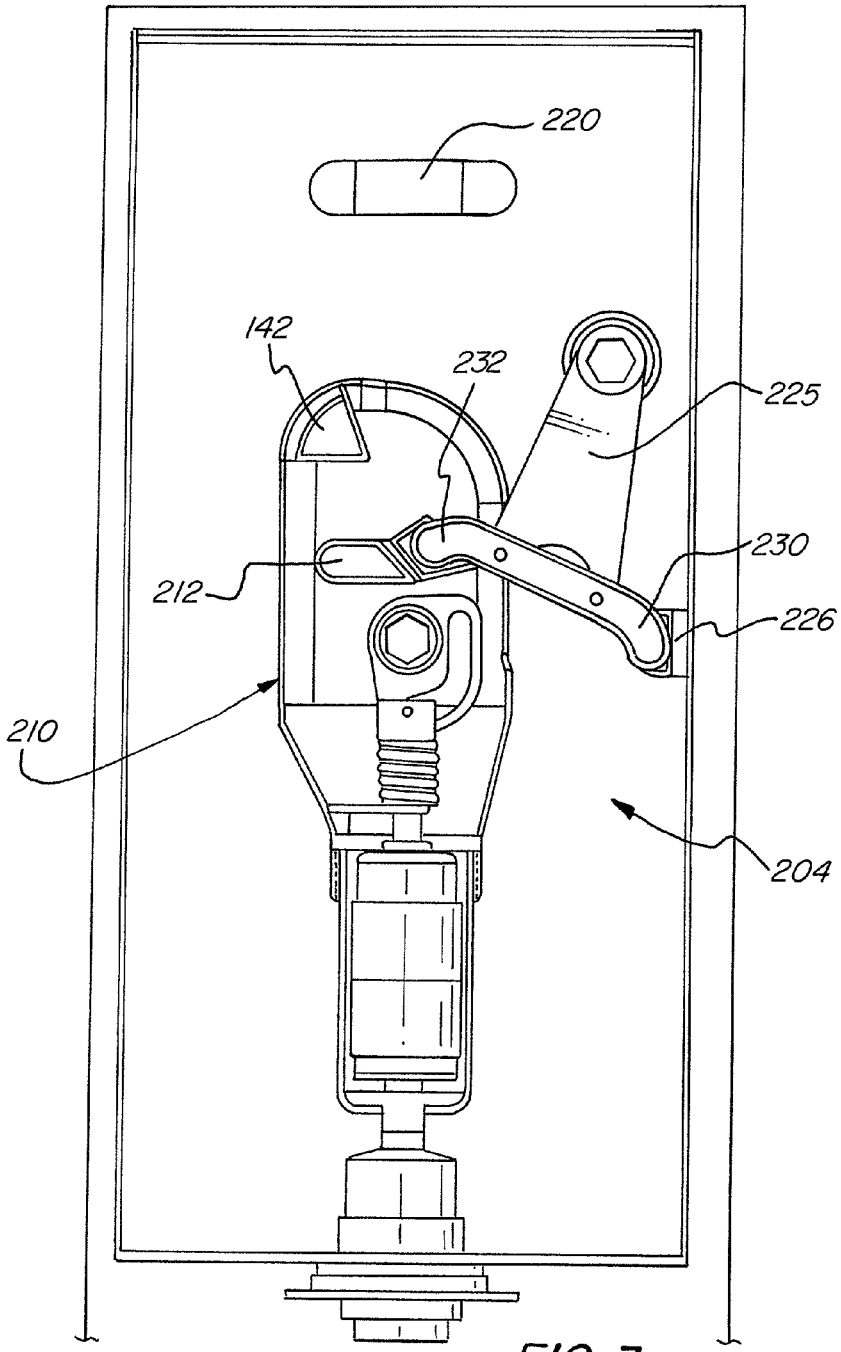
Figure 4:
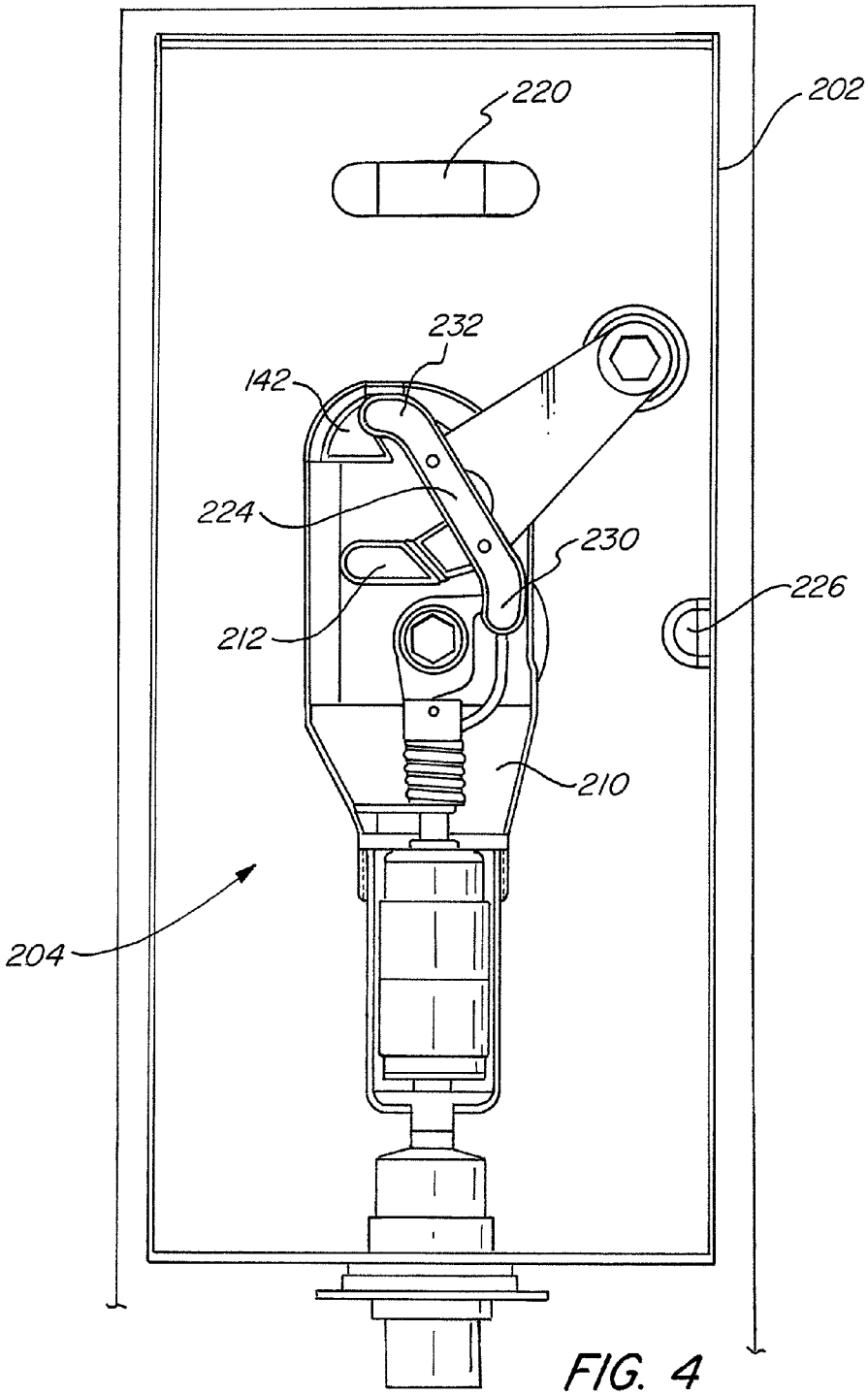

FIGS. 2-4 show schematically a second embodiment of the switchgear and a second embodiment of the switching device according to the present invention. The switchgear comprises a metal encapsulation 202 inside which a plurality of switching devices 204, only one of which is shown in the figure, are housed. The switching devices not shown in the figure are arranged in parallel with the one shown and are thus either hidden behind the one shown or located in planes in front of the latter and not shown in the figure. A wall of the encapsulation 202 is penetrated by a number of electrical bushings 206, one for each phase of a plural phase system. From each electrical bushing 206 a respective conducting element 208, only one of which is shown in the figure, extends to the respective switching device 204. On the outside of the encapsulation 202 the electrical bushings 206 are connected to cables, not shown, that either connect the switchgear to a load or to a medium or high voltage power distribution line.

Each switching device 204 of the second embodiment comprises a breaker 126, guiding members 150, 152 and a shaft 158 as disclosed above in connection with FIG. 1. The housing 210 of the switching device 204 of FIGS. 2-4 has a slightly different design in relation to the housing of FIG. 1. The terminal 142 of the second embodiment has a different location, and the housing 210 is provided with a housing element 212 which will be described in more detail below. Further, instead of a sliding contact element, the switching device 204 comprises a flexible electrical conductor 214 having a first end portion, or end, 216 and a second end portion, or end, 218, the first end portion 216 of the flexible electrical conductor 214 being physically and electrically connected to the second contact 148 of the breaker 126, and the second end portion 218 of the flexible electrical conductor 214 being physically and electrically connected to the contact surface 160 of the housing 210. The flexible electrical conductor 214 can be in the form of a strap, for example formed of thin copper ribbons. However, other possible flexible electrical conductors are known to the skilled person. As mentioned in connection with FIG. 1, each switching device 204 is electrically connectable to and herein also includes an electrical conductor 220, in the form of a busbar, and each switching device 204 includes a switch 222 for electrically connecting the housing 210 to the electrical conductor 220. The switch 222 comprising a conductive switch element 224 movable to a first position (see FIG. 2) in which the switch element 224 is electrically connected to the terminal 142 of the housing 210 and to the electrical conductor 220, movable to a second position (see FIG. 3) in which the switch element 224 is disconnected from the electrical conductor 220 and electrically connected to the housing element 212 of the housing 210 and to a grounded element 226, and movable to a third position (see FIG. 4) in which the switch element 224 is disconnected both from the electrical conductor 220 and from the grounded element 226.

The switch element 224 may be adapted to move in a slot provided in the housing 210, in which slot the terminal 142 and the housing element 212 may be provided. Hereby, the outer shape and the outer surface of the housing 210 remain smooth.

The switch 222 acts as a so called safety switch, or selector switch, which is not adapted to break a medium or high voltage circuit itself, but only to disconnect the breaker from a medium or high voltage line after breaking has been performed by means of the breaker. The reasons why the above-mentioned three positions of the switch element 224 are used during operation of the switchgear are well known to persons skilled in the art and are not described in more detail herein. The second position of the switch 222 may be regarded as a safety position, enabling safe repair and service on components such as cables connected to the switchgear.

The switch element 224 is pivotable about an axis of rotation 228 and pivotable between the first, second and third positions. The axis of rotation 228 of the switch element 224 is located outside the outer surface 234 of the housing 210, and the switch element 224 is pivotally mounted to its axis of rotation 228 outside the housing 210 via en intermediate element 225 which connects the switch element 224 to the axis of rotation 228. The axis of rotation 228 of the switch element 224 is located outside the switch element 224. The switch element 224 has a first end portion, or end, 230 and a second end portion, or end, 232, between which the switch element 224 extends. In the first position (see FIG. 2) the first end portion 230 of the switch element 224 is physically and electrically connected to the terminal 142 of the housing 210 and the second end portion 232 of the switch element 224 is physically and electrically connected to the electrical conductor 220. In the second position (see FIG. 3) the second end portion 232 of the switch element 224 is disconnected from the electrical conductor 220 and physically and electrically connected to the housing element 212 of the housing 210, and the first end portion 230 of the switch element 224 is physically connected to the grounded element 226. In the third position (see FIG. 4), the switch element 224 is situated within the outer surface of 234 the housing 210, and both the first and second end portions 230, 232 of the switch element 224 are physically and electrically connected to the housing 210, where the first end portion 230 is physically connected to the housing element 212 of the housing 210, and the second end portion 232 is physically connected to the terminal 142.

The terminal 142 and the housing element 212 may also be designed to form one part, i.e. the terminal may be integral with the housing element.

By the innovative design of the switch 222, the distribution of the electric field and the electric field stress is improved, and enables a switchgear with a compact design.

Figure 5:
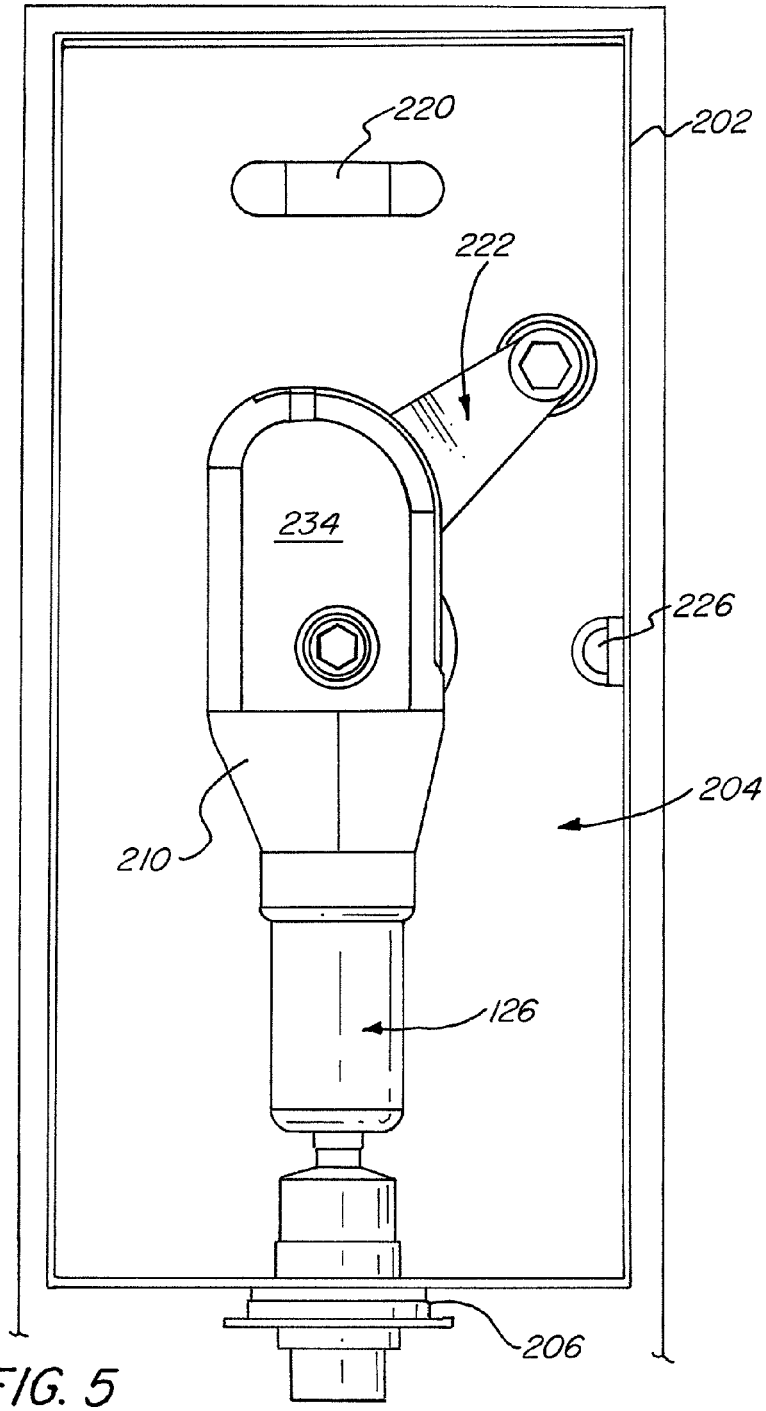
FIG. 5 is a schematic view of the exterior of the housing of the second embodiment of the switching device of FIGS. 2-4.

FIG. 5 shows the exterior of the housing 210 shown in FIGS. 2-4. The outer shape of the housing 210 and the outer surface 234 of the housing 210 are smooth to distribute the electric field generated by the voltage of the current through the switching device. The outer shape, or the outer geometry, of the housing 210 is smooth in that the housing does not have an angular outer shape and is without roughness. The outer surface 234 of the housing 210 is smooth in that the surface has no roughness, sharp projections or sharp indentations.

Each housing of the embodiments described above is adapted to be at an electric potential which is substantially equal to the electric potential of the second contact of the breaker during the operation of the switching device. Each housing of the embodiments described above is adapted to form a part of the current path, which current path part extends between the first and second end portions of the housing, more precisely between the first end portion of the housing and the terminal, and more precisely between the contact surface of the housing and the terminal.

It is to be understood that the switchgear may comprise a plurality of switchgears, or units, such as the one described above. For each electric phase there may be a common bus bar, like the electrical conductor described above, which extends from unit to unit. The encapsulation may or may not be common for the plurality of switchgears/units. The encapsulation may be filled with an electrically insulating gas or gas mixture, which may be pressurised. Air-filled encapsulations are also possible.

The invention shall not be considered limited to the embodiments illustrated, but can be modified and altered in many ways by one skilled in the art, without departing from the scope of the appended claims.

What is claimed is:

1. A switching device for electric power distribution, electrically connectable to an electrical conductor, the switching device comprising a breaker electrically connectable to the electrical conductor, and an electrically conductive housing to which the breaker is mounted, the switching device providing a current path between the breaker and the electrical conductor, and the housing houses at least one guiding member for operating the breaker, the at least one guiding member being movable in relation to the housing, the housing having an outer surface, and the housing has a smooth outer shape to distribute the electric field generated by the voltage of the current through the switching device, wherein the switching device comprises a switch or electrically connecting the housing to the electrical conductor, the switch comprising a switch element movable to a first position in which the switch element is electrically connected to the housing and to the electrical conductor, movable to a second position in which the switch element is disconnected from the electrical conductor and electrically connected to the housing and to a grounded element, and movable to a third position in which the switch element is disconnected from the electrical conductor and from the grounded element, wherein the switch element is pivotable about an axis of rotation and pivotable between the first, second and third positions, characterized in that the axis of rotation of the switch element is located outside the outer surface of the housing, and in that in the third position, the switch element is situated within the outer surface of the housing.

2. The switching device according to claim 1, characterized in that at least one portion of the housing forms part of the current path between the breaker and the electrical conductor.

3. The switching device according to claim 2, characterized in that the housing comprises a first end portion, to which the breaker is mounted, and a second end portion including a terminal via which the current path exits the housing to reach the electrical conductor, the housing extending axially between the first and second end portions, and in that the housing is adapted to form a part of the current path which extends between the first and second end portions of the housing.

4. The switching device according to claim 3, characterized in that the housing is adapted to form a part of the current path which extends between the first end portion of the housing and the terminal.

5. The switching device according to claim 3, characterized in that the breaker comprises an electrically conductive first contact and an electrically conductive second contact, the second contact being movable in relation to the first contact and in relation to the housing, and when the first and second contacts are in contact the breaker is in a closed position, and when the first and second contacts are separated the breaker is in an open position, and in that the second contact is electrically connected to the housing at the first end portion thereof.

6. The switching device according to claim 5, characterized in that the housing is adapted to be at an electric potential which is substantially equal to the electric potential of the second contact of the breaker during the operation of the switching device.

7. The switching device according to claim 5, characterized in that the housing has an inner surface which comprises a contact surface, in that the second contact of the breaker is provided with a sliding contact element which is in electrical contact with the second contact, and in that the sliding contact element is in sliding and electrical contact with the contact surface of the housing.

8. The switching device according to claim 5, characterized in that the housing has an inner surface which comprises a contact surface, in that the switching device comprises a flexible electrical conductor having a first end portion and a second end portion, the first end portion of the flexible electrical conductor being electrically connected to second contact of the breaker, and the second end portion of the flexible electrical conductor being electrically connected to the contact surface of the housing.

9. The switching device according to claim 7, characterized in that the housing is adapted to form a part of the current path which extends between the contact surface of the housing and the terminal.

10. The switching device according to claim 1, characterized in that the housing is provided with a through-hole for suspension of the housing.

11. The switching device according to claim 10, characterized in that the switching device comprises a shaft inserted into the through-hole of the housing, in that the shaft is rotatable about its longitudinal axis and in relation to the housing, in that the shaft is connected to the at least one guiding member, and in that the shaft and its rotation is adapted to control the movement of the at least one guiding member.

12. The switching device according to claim 1, characterized in that the housing is made of at least one casted part.

13. A switchgear for electric power distribution, the switchgear comprising at least one switching device according to claim 1.

* * * * *